US007264542B1

(12) United States Patent
Leyva

(10) Patent No.: US 7,264,542 B1
(45) Date of Patent: Sep. 4, 2007

(54) KNIFE SHARPENING METHOD AND SYSTEM

(75) Inventor: Ronald P. Leyva, 6402 Japatul Highlands Rd., Alpine, CA (US) 91901

(73) Assignee: Ronald P. Leyva, Alpine, CA (US)

( * ) Notice: Subject to any disclaimer, the term of this patent is extended or adjusted under 35 U.S.C. 154(b) by 0 days.

(21) Appl. No.: 11/363,808

(22) Filed: Feb. 28, 2006

(51) Int. Cl.
*B24D 9/10* (2006.01)

(52) U.S. Cl. ..... 451/494; 451/523; 451/538; 451/539

(58) Field of Classification Search ..... 451/494, 451/523, 524, 525, 530, 538, 539, 45
See application file for complete search history.

(56) References Cited

U.S. PATENT DOCUMENTS 4,437,271 A * 3/1984 McAvoy ..... 451/532
5,007,483 A * 4/1991 McGuire ..... 168/48.1
5,522,763 A * 6/1996 Regnier ..... 451/502
6,116,998 A * 9/2000 Damgaard et al. ..... 451/490
6,439,983 B1 * 8/2002 McCoy et al. ..... 451/354
6,991,529 B2 * 1/2006 Annis et al. ..... 451/557
2001/0000503 A1 * 4/2001 Beaudry et al. ..... 451/523
2004/0063390 A1 * 4/2004 Codd ..... 451/523
2004/0229016 A1 * 11/2004 Lipstein ..... 428/143
2005/0095968 A1 * 5/2005 Mick ..... 451/523

* cited by examiner

*Primary Examiner*—Eileen P. Morgan
(74) *Attorney, Agent, or Firm*—Bernard L. Kleinke; Duckor Spradling Metzger & Wynne

(57) ABSTRACT

A method and system are disclosed. The system may include a device for sharpening a convex edge on the blade of a knife. The device may include a resilient material and a plurality of abrasive sheets of varying grit values. Each abrasive sheet may be removably attachable to a top of the resilient material. The method may include placing the blade against the abrasive surface at a small angle with a first side of an edge to be sharpened of the blade contacting the abrasive surface and a spine of the blade elevated above the abrasive surface, applying a downward force on the blade causing the edge to be sharpened to compress the resilient abrasive surface, and moving the first side of the edge to be sharpened along the abrasive surface in the direction of the spine.

11 Claims, 5 Drawing Sheets

KNIFE SHARPENING METHOD AND SYSTEM

BACKGROUND OF THE INVENTION

1. Field of the Invention

The present invention relates in general to the sharpening of knifes. It more particularly relates to a method and system for sharpening the blades of knifes to have a convex edge.

2. Background Art

There is no admission that the background art disclosed in this section legally constitutes prior art.

Knives are common household items. With typical use and/or abuse, the blade or cutting edge of the knife will lose some of its sharpness. Individuals using knives want them to be sharp and feel knives are safer to use when they are sharp. However, keeping the blade sharp is not easy and requires periodic sharpening. Some knife owners prefer to have their knives professional sharpened and other knife owners prefer to sharpen their own knives.

The edge of a blade can come in a variety of shapes with V-shaped edge, beveled edge, chisel edge, and convex edge being the most common. Of these edges the convex edge is typically considered the best because it combines a high performance edge, while maintaining the strength of the blade. However, drawbacks of the convex edge are its difficulty to manufacture and its difficulty to sharpen.

One method of sharpening a convex edge involves using a grinding wheel, a stone, or other non-resilient abrasive materials. When sharpening a convex edge using one these items, the blade must be appropriately rotated to maintain the convex shape of the edge. A considerable amount of skill is required to properly sharpen a convex edge in this manner.

Another method of sharpening a convex edge has been proposed, and involves using a mouse pad with sandpaper attached to one or both sides. This method is only mentioned in regards to sharpening blades with existing convex edges, and details surrounding its actual performance or technique are lacking.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DESCRIPTION OF CERTAIN EMBODIMENTS OF THE INVENTION

Figure 1:
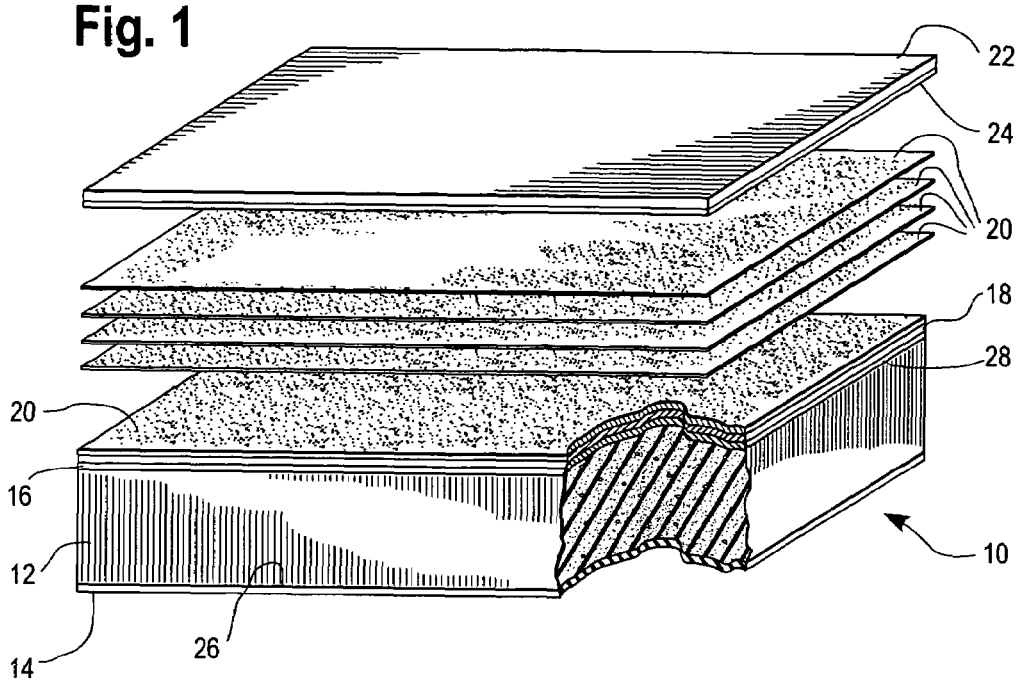
FIG. 1 is a perspective view of an embodiment of a blade sharpening device of the present invention.
Figure 2:
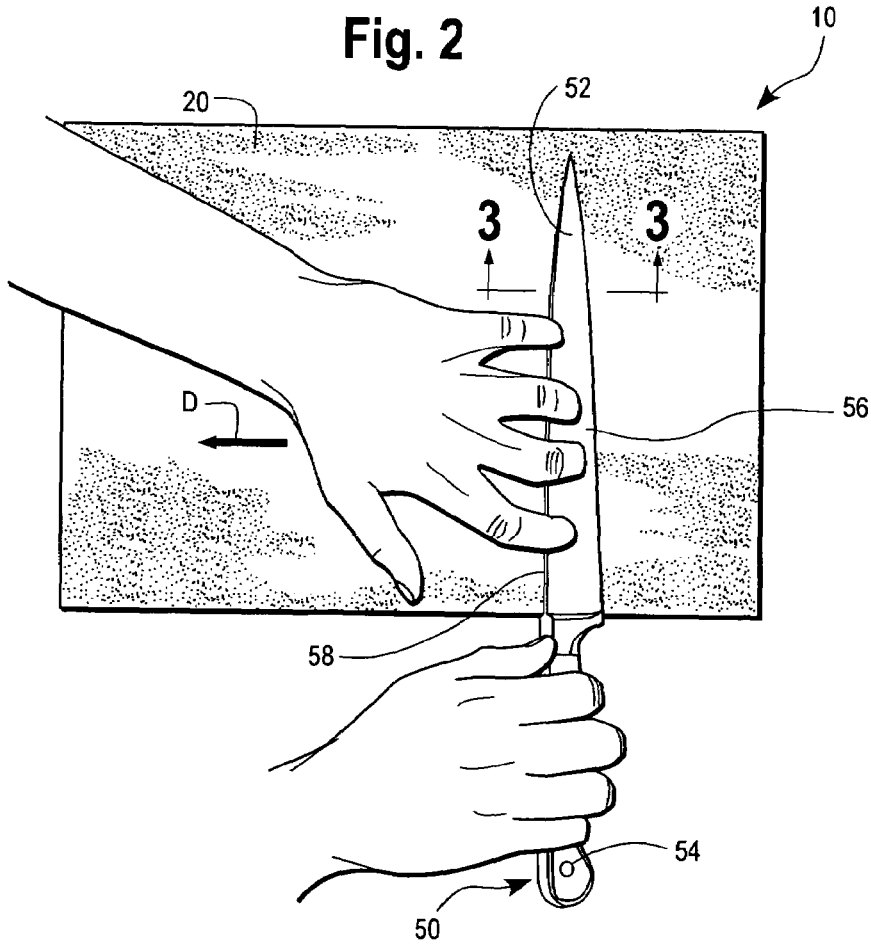
FIG. 2 is a top view of the blade sharpening device of FIG. 1 including a knife being sharpened.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

A method and system are disclosed, and may include a method of sharpening a blade to a convex edge on a resilient abrasive surface. The method may include placing the blade against the abrasive surface at a small angle with a first side of an edge to be sharpened of the blade contacting the abrasive surface and a spine of the blade elevated above the abrasive surface, applying a downward force on the blade causing the edge to be sharpened to compress the resilient abrasive surface, and moving the first side of the edge to be sharpened along the abrasive surface in the direction of the spine.

In accordance with another disclosed embodiment of the invention, there is provided a device for sharpening blades, which may include a resilient material and a plurality of abrasive sheets of varying grits. Each sheet may be removably attachable to a top of the resilient material According to another aspect of a disclosed embodiment of the invention, there is provided a method of removably attaching abrasive sheets of varying grits to a resilient material for sharpening blades. The method may include attaching a first magnetic sheet to the resilient material, coating one side of a second magnetic sheet with a repositionable adhesive, attaching the second magnetic sheet to the first magnetic sheet such that the adhesive coated side is opposite the first magnetic sheet, and removably attaching one of the abrasive sheets to the adhesive coated side of the second magnetic sheet.

In accordance with yet another disclosed embodiment of the invention, there is provided device for sharpening blades, which may include a resilient material having measurements of approximately 11 inches long, 9 inches wide, and 2 inches in height and an abrasive sheet attached to the resilient material.

According to yet another aspect of a disclosed embodiment of the present invention, there is provided a method for sharpening a blade to a convex edge on a resilient abrasive surface. The method may include placing the blade against the abrasive surface at a small angle with a first side of an edge to be sharpened of the blade contacting the abrasive surface and a spine of the blade elevated above the abrasive surface, applying a downward force on the blade causing the edge to be sharpened to compress the resilient abrasive surface, and moving the first side of the edge to be sharpened along the abrasive surface in the direction of the spine.

Figure 3:
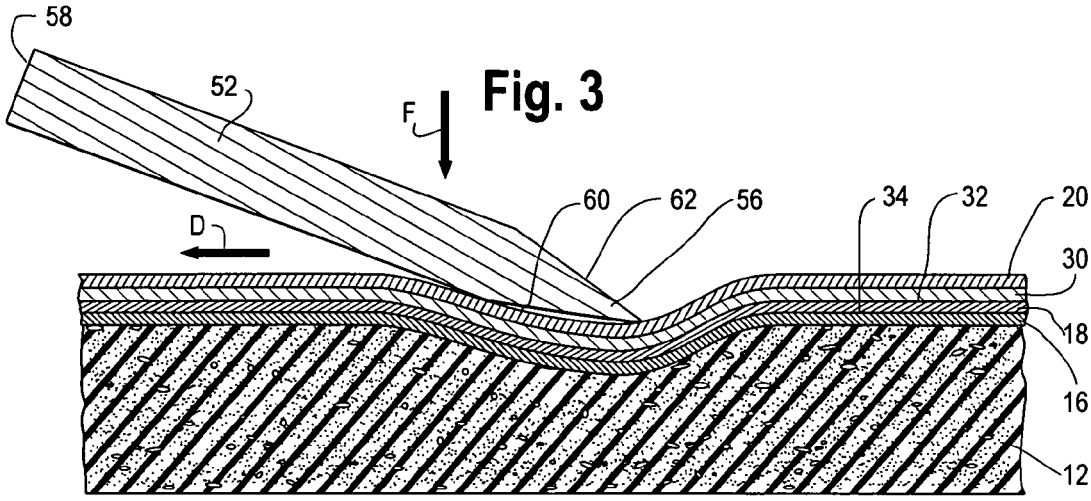
FIG. 3 is a side view of the blade sharpening device of FIG. 2 with the knife being sharpened.

Referring to FIGS. 1 and 3, an embodiment of the present invention as a blade sharpening device is shown. The blade sharpening device 10 may include a resilient material 12, a nonskid pad 14, a first and a second flexible magnetic sheet 16, 18, a plurality of abrasive sheets 20, and a leather sheet 22 mounted to a third flexible magnetic sheet 24.

The resilient material 12 may be a pad made of foam, rubber, or other resilient material having dimensions of approximately 11 inches long, approximately 9 inches wide, and approximately 2 inches in height. The height of the resilient material 12 may allow the hand of a person grasping the handle of a knife being sharpened to move freely over a tabletop or other surface the blade sharpening device may be resting on at the time. The resilient material 12 may be in a density range, such that the percent of rebound for the material may be in a range of about 20% to about 80%, with a preferred rebound range being about 50% to about 70%. A high resiliency polyurethane foam, such as HR70 having a rebound of 70%, may have a density well suited for this application, however other suitable resilient materials having higher or lower densities may also be used.

Figure 12:
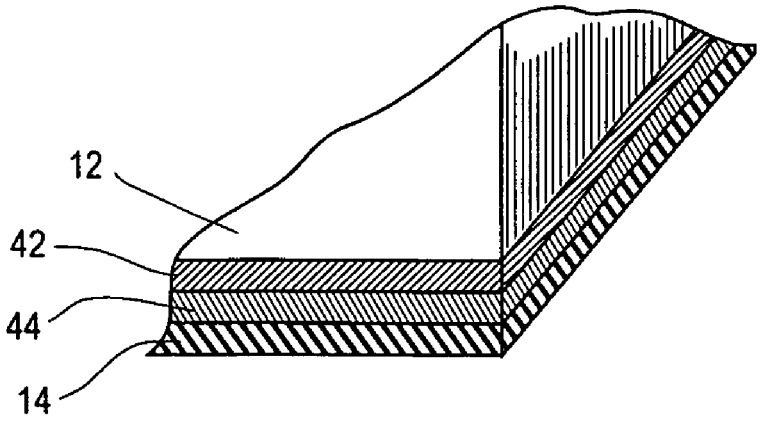
FIG. 12 is a partial side view of another embodiment of the attachment of a nonskid pad to the resilient material in the device of FIG. 1.

The nonskid pad 14 may be permanently attached to a bottom side 26 of the resilient material 12 by an appropriate adhesive or other technique and may be made of any of a multitude of nonskid materials, such as rubber or other materials or even include suction cups (not shown), such as on a bath mat. As shown in FIG. 12, the nonskid pad 14 may also be attached to the resilient material 12 utilizing a fourth and a fifth flexible magnet sheet 42, 44. The fourth magnet sheet may be permanently attached to the bottom side 26 of the resilient material 12 and the fifth magnet sheet 44 may be permanently attached to the nonskid pad 14. The nonskid pad 14 may then be removably attached to the resilient material 12 by magnetically attaching the fourth magnet sheet 42 to the third magnetic sheet 44. The magnetic sheets may improve the performance of the nonskid pad by increasing its rigidity. Other ways of improving the rigidity of the nonskid pad may also be used, such as permanently attaching a rigid material sheet (not shown) between the nonskid pad and the resilient material.

The first magnetic sheet 16 may be permanently attached to a top side 28 of the resilient material 12 by an appropriate adhesive or other technique. The second magnetic sheet 18 may include on a first side 32 a repositionable adhesive coating layer 30 using a suitable adhesive. A second side 34 of second magnetic sheet 18 may be placed in magnetic contact with the first magnetic sheet 16 exposing the repositionable adhesive coating layer 30.

The abrasive sheets 20 may be removably attached to the repositionable adhesive coating layer 30 on the second magnetic sheet 18. The adhesive coating layer 16 and the magnetic attraction between the first magnetic sheet 16 and the second magnetic sheet 18 may firmly hold the abrasive sheet 20 to the resilient material 12 to help avoid any slippage between the abrasive sheet 20 and the resilient material 12. A model of the device 10 was built and tested, and the magnet sheets were obtained from www.custom-magnets.com, the magnetic sheets having a PSA adhesive back which was sprayed with one coat of adhesive under the trade name "Remount" made by 3M of St. Paul, Minn., followed by two coats of adhesive under the trade name "Easy-Tack" made by Krylon of Cleveland, Ohio.

With the top dimensions of the resilient material 12 approximately 11 inches long and 9 inches wide, the abrasive sheets 20 may be standard sized sheets of sandpaper of varying grits. The typical grit values for the sandpaper utilized in the device 10 may vary from about 60 to about 2500 with 60 being a very coarse grit and 2500 being a very fine grit.

The leather sheet 22 may be permanently attached to the third magnetic sheet 24 using an appropriate adhesive, since the durability and useable time period for the leather sheet may be significantly greater than that of the sandpaper sheets. To utilize the leather sheet 22, the second magnetic sheet 18 having the adhesive coating layer 30 may be removed from the blade sharpening device 10 and the adhesive coating layer 30 protectively covered with a sheet covered with a non-stick material, such as Teflon® or a similar material. The leather sheet 22 may then be attached to the resilient material 12 by magnetically attaching the third magnetic sheet 24 directly to the first magnetic sheet 16.

Due to the nature of the activity of the blade sharpening device, i.e. creation of small particles of metal, cleaning the various parts of the device may be necessary. A short bristled paint brush may be used for removing the steel particles from the abrasive sheets. A lightly damp sponge or rag may be used to clean off the nonskid pad. For cleaning off the magnetic sheets, a cleaning cream for ceramic cooktops may be utilized.

Referring now to FIGS. 2, 3, and 7-11, a method of sharpening a knife blade using the blade sharpening device is disclosed. An abrasive sheet 20 having an appropriately low grit value for the condition of the blade to be sharpened may be attached to the top of the blade sharpening device 10. A knife 50 may be positioned over the blade sharpening device 10 such that a blade 52 of knife 50 extends over the device 10 and a handle 54 of knife 50 extends past the device 10. The knife 50 may include an edge 56 for cutting and a spine 58. The cutting edge 56 may include a first side 60 and a second side 62

Figure 7:
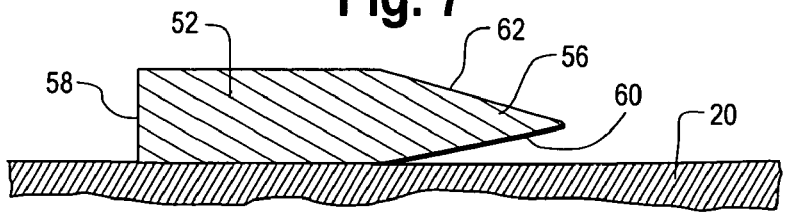
FIGS. 7-11 are side views showing an embodiment of the steps of the method of sharpening a blade of the present invention.
Figure 8:
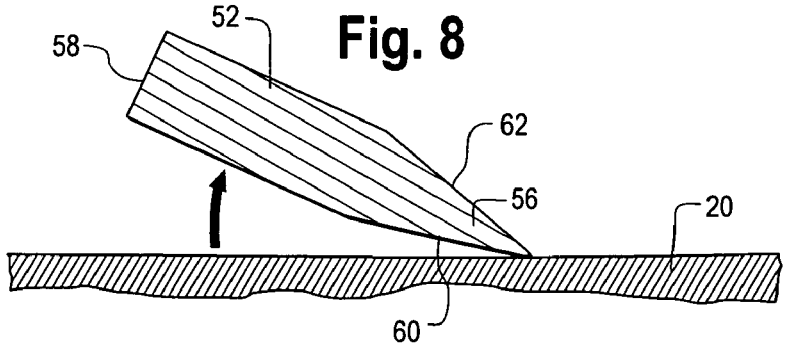

The blade 52 of the knife 50 may initially be laying flat on the surface of the abrasive sheet with both the first side 60 of the edge 56 and the spine 58 directly adjacent the abrasive sheet as shown in FIG. 7. The spine 58 of the blade 52 may then be elevated slightly off the abrasive sheet to create a small angle between the blade 52 and the top of the device 10 as shown in FIG. 8. This angle between the blade 52 and the top of device 10 may be as small as possible to allow clearance of the upper part of the blade 52 and may be in the range of about 0 degrees to about 30 degrees. With the blade 52 at this angle, the first side 60 of the edge 56 of the blade 52 may be in contact with the abrasive sheet 20 on top of the device 10, and the spine 58 of the blade 52 elevated above the abrasive sheet 20.

Figure 9:
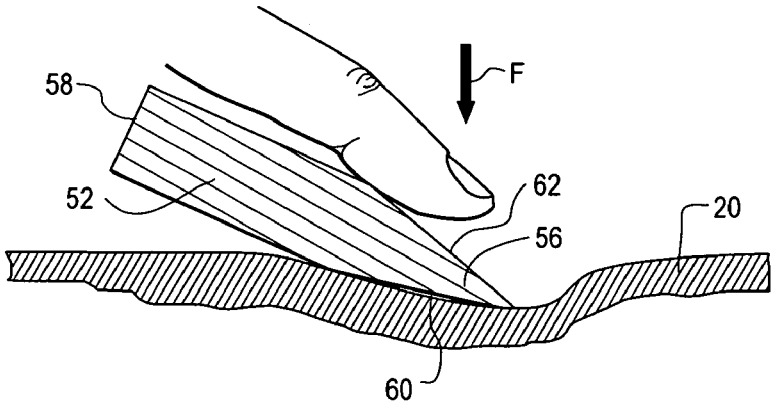

To initiate sharpening of the first side 60 of the edge 56 of the blade 52 in this angled position, a downward force F may be applied to the blade 52 of the knife 50 as shown in FIG. 9 by the hand of the user or other suitable force applying technique. The force F may be applied by the fingers of one hand or some mechanical device (not shown) and may be sufficient to deform the abrasive sheet 20 and the magnetic sheets 16, 18 and to compress the resilient material 12 of the device 10 below the edge 56 of the blade 52.

Figure 10:
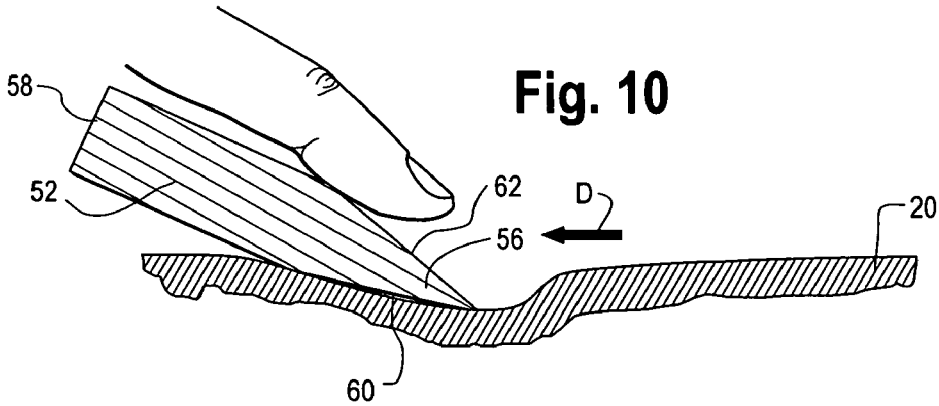
Figure 11:
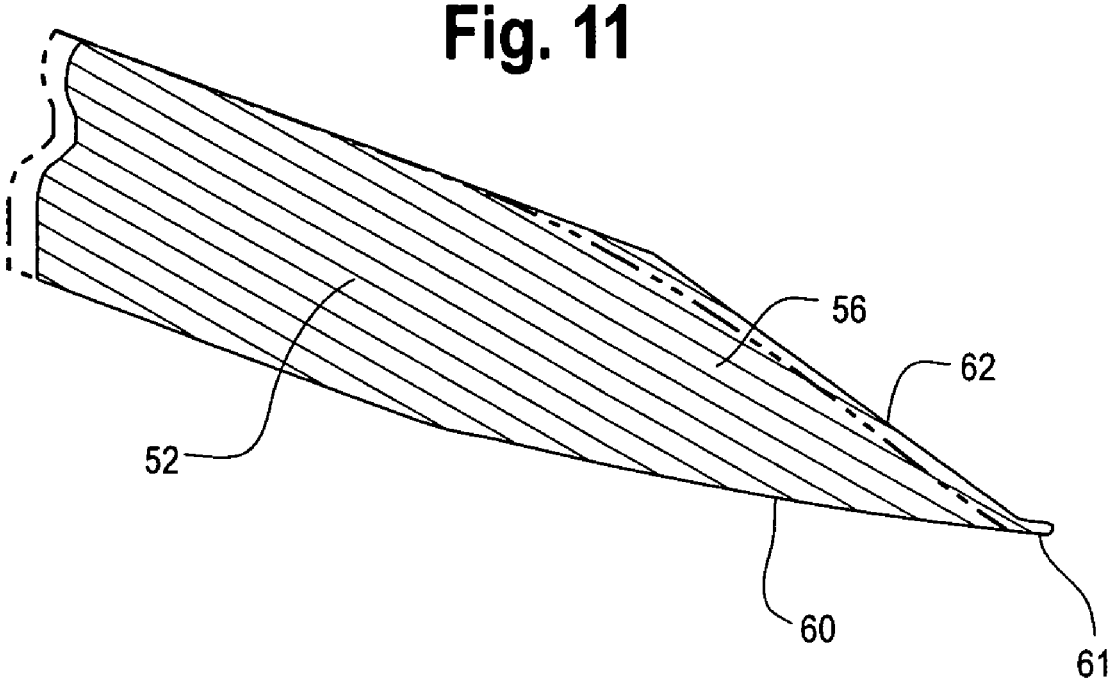

With the blade 52 in the angled position and downward force F applied to the blade 52, the blade 52 may be moved transversely at approximately right angles to the side edge of the device 10, in a substantially straight line across the abrasive sheet 20 by moving the edge 56 toward the spine 58 in direction D as shown by FIG. 10. With a narrower abrasive sheet, the knife blade may be positioned at an angle (not shown). This movement may be generated using the opposite hand or some mechanical device (not shown) grasping and pulling the handle 54 of the knife 50. When the blade 52 approaches the end of the abrasive sheet 20, the movement in direction D and the downward force F may be discontinued terminating the stroke and the blade 52 may be lifted vertically off the abrasive sheet 20 and moved back to its original starting position maintaining the angle between the blade 52 and the abrasive sheet 20 to begin another stroke. This stroke may be repeated a plurality of times until the generation of a rolled over wire edge or bead 61 (FIG. 11) along the edge 56 of the blade 52. This wire edge 61 may be felt along the second side 62 of the edge 56 by the fingers of the user.

After the generation of the wire edge 61, the knife 20 may be rotated to allow sharpening of the second side 62 of the edge 56 of the blade 52. The above steps may be repeated for the second side 62 of the edge 56 until the generation and/or rolling over of a new or the previous wire edge that may be felt along the first side of the edge 56. The sharpening of the knife 50 may continue by alternating between a few strokes to sharpen the first side 60 of the edge 56 and a few strokes to sharpen the second side 62 of the edge 56. This may continue until the sharpening involves alternating strokes between the first side 60 and the second side 62 of the edge 56 while simultaneously reducing the downward force F on the blade 52. These final strokes may totally eliminate any wire edge or bead from the edge 56 of the blade 52.

After sharpening the edge of the blade using the original abrasive sheet having a low grit value, the original abrasive sheet may be removed from the blade sharpening device and replaced with a second abrasive sheet having a higher grit value. The blade may be again sharpened as described above using this second abrasive sheet to further refine the sharpened edge. The sharpening of the blade may continue with each abrasive sheet being replaced with an abrasive sheet having a higher grit value. The final step may be replacing the last abrasive sheet with the leather sheet and sharpening the edge of the blade as described above to a very smooth sharp edge.

Using this method to sharpen blades, blades originally having convex edges may be sharpened to maintain the convex edges, and blades originally having edges of some other form, such as a V-shaped edge, or a beveled edge, may be sharpened to a convex edge. Furthermore, blank blades may be originally sharpened, using examples of this method, to form convex edges.

Figure 4:
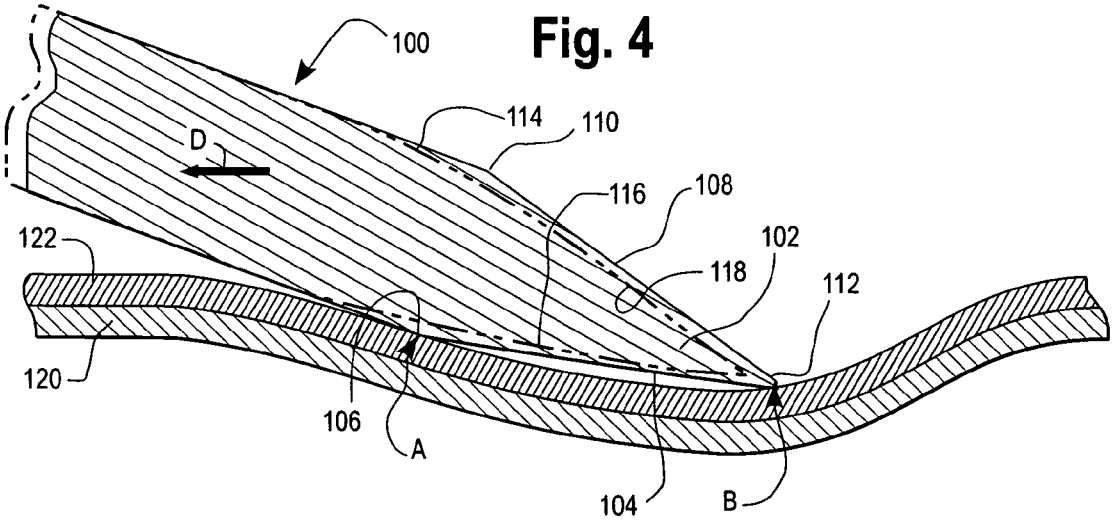
FIG. 4 is an enlarged side sectional view of the blade being sharpened.

Referring now to FIG. 4, a dull originally V-shaped edge blade being sharpened to a convex edge blade is shown. The blade 100 may include a V-shaped edge 102 having a first side 104 starting from a first point 106, a second side 108 starting from a second point 110, and a dulled edge 112 at the ends of the first side 104 and the second side 108 of the V-shaped edge 102. Due to the shape of the blade 100 and the compression of the resilient material 120, the first point 106 and one side of the dulled edge 112 may be positions on blade 100 initially under the greatest pressure against the abrasive sheet 122. Blade material from and around these positions may be removed initially to transform the first side 104 of the V-shaped edge 102 into a first side 116 of a convex edge 114. Similarly, the second side 108 of the V-shaped edge may be transformed into a second side 118 of the convex edge 114.

It is envisioned that this method of sharpening blades may be utilized by individuals personally sharpening their own knifes or by knife manufacturers mass producing knifes.

Figure 5:
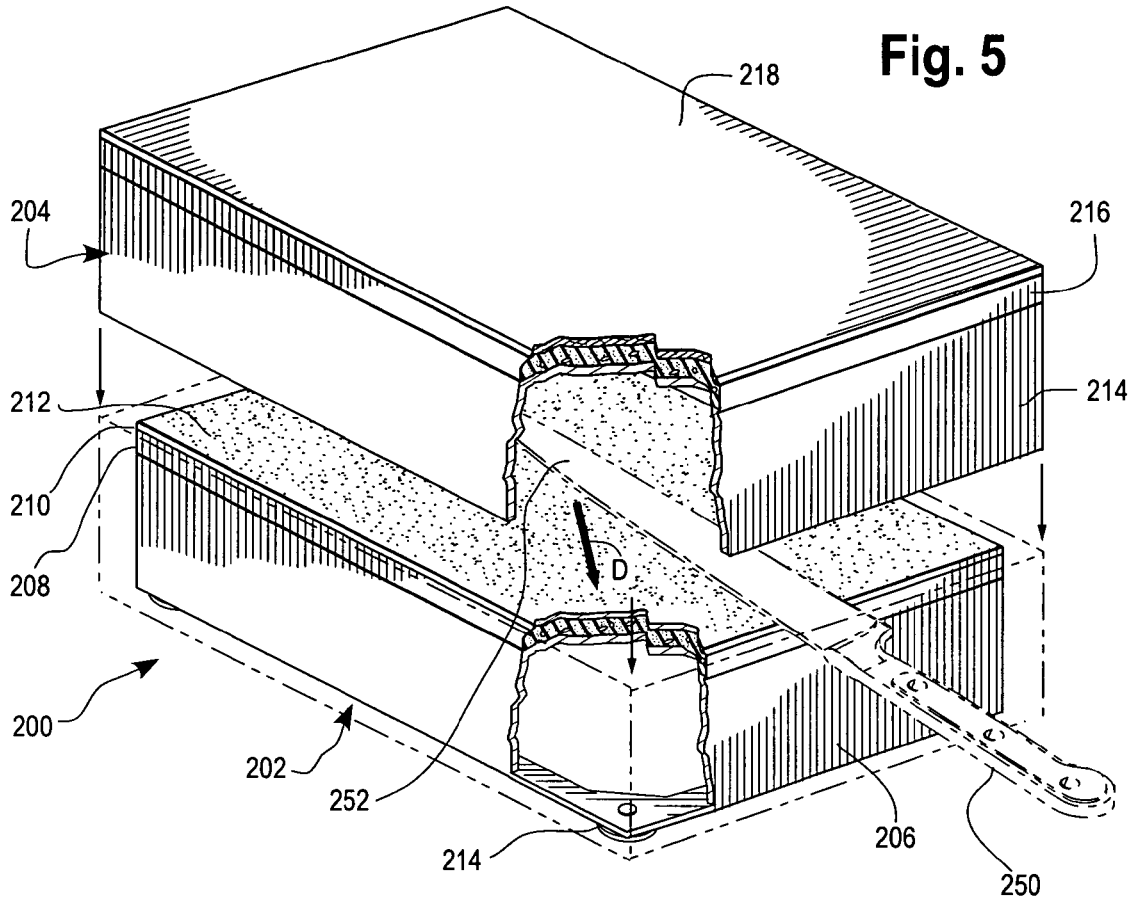
FIG. 5 is a perspective view of another embodiment of the blade sharpening device.
Figure 6:
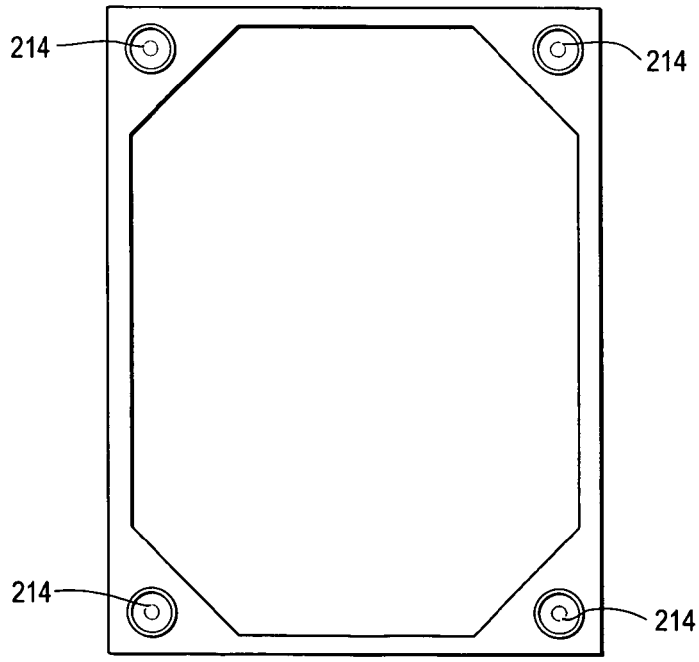
FIG. 6 is a bottom view of the blade sharpening device of FIG. 5.

Referring now to FIGS. 5 and 6, a second embodiment of a blade sharpening device is shown. The blade sharpening device 200 may include a lower unit 202 and an upper unit 204.

The lower unit 202 may include a rigid box 206, a thin resilient pad 208 permanently attached to the rigid box 206, a coating 210 of a repositionable adhesive on top of the resilient pad 208, and an abrasive sheet 212 removably attached to the coating 210. The bottom of the rigid box 206 may include a plurality of suction cups 214 or other nonskid surface to hold the box 206 in place during operation. Additional abrasive sheets (not shown) of varying values of grit may be included with the lower unit 202 and exchanged with the original abrasive sheet 212 during the process of sharpening a knife. A nonstick sheet (not shown) covered with a non-stick material, such as Teflon® or a similar material, may also be included with lower unit to cover and protect the repositionable adhesion coating 210 when not in use.

The upper unit 204 may fit over the top of the lower unit 202 and may include a lid portion 214, a thin resilient pad 216 permanently attached to a top of the lid portion 214, and a leather sheet 218 permanently attached to the thin resilient pad 216. During storage the upper unit 204 may fit snugly over the lower unit 202 containing the abrasive sheets on top of the lower unit 202. During the sharpening of a knife, the upper unit 204 may be removed and set aside while the knife is being sharpened using the various abrasive sheets. Upon completion of the sharpening with the abrasive sheets, the upper unit 204 may be place on top of the lower unit 202 and the final stage of sharpening of the knife using the leather sheet 218 may be accomplished.

The method of sharpening a knife using the blade sharpening device 200 may be identical to the method previously described for knives having blades shorter in length than the length of the blade sharpening device 200. However, if sharpening a knife 250 having a blade 252 longer than the blade sharpening device 200 as shown in FIG. 5, the movement of the blade 252 across the abrasive sheet 212 may be modified. In order to sharpen the entire blade 252, the movement across the abrasive sheet 212 may be in the direction D indicated by the arrow, such that entirety of the blade 252 may be moved across the abrasive sheet during one stroke of the process. This type of movement may also be used when sharpening blades longer than the blade sharpening device 10.

As used herein, the terms "approximately" and "about" indicate possible variations of plus or minus 20 percent.

While particular embodiments of the present invention have been disclosed, it is to be understood that various different embodiments are possible and are contemplated within the true spirit and scope of the appended claims. There is no intention, therefore, of limitations to the exact abstract or disclosure herein presented.

What is claimed is:

1. A kit for sharpening blades, comprising a block of resilient material for resting on a generally flat supporting surface in use, the block having a first flexible magnetic sheet permanently attached to a top side thereof;

said top side having a dimension of approximately 11 inches long and 9 inches wide;

a plurality of abrasive sheets of varying grit values;

each one of said abrasive sheets having a dimension of approximately 11 inches long and 9 inches wide;

a second flexible magnetic sheet for magnetically attaching to the first flexible magnetic sheet;

means including an adhesive layer for attaching one of the abrasive sheets removably to the second flexible magnetic sheet; and a non-skid, non-abrasive surface attached to a bottom side of the resilient material for securing the block in a stationary manner by frictional engagement with the supporting surface.

2. The kit of claim 1, wherein said adhesive layer includes a repositionable adhesive coating on the resilient material for removably attaching each sheet to the resilient material.

3. The device of claim 1, wherein said non-abrasive surface is a nonskid pad attached to a bottom of the resilient material.

4. The kit of claim 1, wherein said means includes at least one magnetic sheet for removably attaching the abrasive sheets to the resilient material.

5. The kit of claim 1, wherein the resilient material is a polyurethane foam.

6. The kit of claim 1, wherein at least one of the plurality of abrasive sheets is a standard sized sheet of sandpaper.

7. The kit of claim 1, wherein at least one of the plurality of abrasive sheets is a leather sheet.

8. A device for sharpening blades, comprising a resilient material having measurements of approximately 11 inches long, 9 inches wide, and 2 inches in height;

a first flexible magnetic sheet permanently attached to the resilient material;

a second flexible magnetic sheet for attaching to the first flexible magnetic sheet on the resilient material;

an abrasive sheet removably attached to the second flexible magnetic sheet; and a non-skid, non-abrasive surface attached to the opposite side of the resilient material.

9. The device of claim 8, wherein the abrasive sheet is a standard sized sheet of sandpaper.

10. The device of claim 8, wherein the abrasive sheet is a leather sheet.

11. The device of claim 8, wherein the resilient material is a polyurethane foam.

* * * * *